US006231385B1

(12) United States Patent
Kuo

(10) Patent No.: US 6,231,385 B1
(45) Date of Patent: May 15, 2001

(54) PANEL MOUNTED ELECTRICAL CONNECTOR

(75) Inventor: Peter Kuo, Chung-Ho (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/474,472

(22) Filed: Dec. 29, 1999

(51) Int. Cl.[7] ..... H01R 13/73
(52) U.S. Cl. ..... 439/557; 439/607; 439/939
(58) Field of Search ..... 439/607–610, 439/939, 350–358, 553, 557

(56) References Cited

U.S. PATENT DOCUMENTS

| | | | | |
|---|---|---|---|---|
| 5,037,325 | * | 8/1991 | Wirkus | 439/467 |
| 5,340,329 | * | 8/1994 | Hirai | 439/357 |
| 5,599,207 | * | 2/1997 | Lai | 439/357 |
| 5,709,569 | * | 1/1998 | Buck et al. | 439/607 |

* cited by examiner

*Primary Examiner*—Gary F. Paumen
(74) *Attorney, Agent, or Firm*—Wei Te Chung

(57) ABSTRACT

An electrical connector mountable at an opening in a panel comprises a dielectric housing with terminals received therein, a shield enclosing the housing, a cable terminated to the terminals, and an insulative casing molded to engage with a rear end portion of the housing and a front end of the cable. A first latch is formed on each side wall of the shield for engaging with a corresponding second latch formed by the panel on each side edge of the opening. A top wall of the shield is accommodated in an upper slot defined between the housing and the casing and is spaced from an upper surface of the housing. A lower slot is also defined between the casing and the housing for receiving a support plate provided by the panel on a bottom edge of the opening thereby securely retaining the connector in position relative to the panel. The casing is made from resilient material and has a push portion at a top, front end thereof. The push portion is depressed against the top wall of the shield to unlatch the first latches of the shield from the second latches of the panel.

1 Claim, 5 Drawing Sheets

PANEL MOUNTED ELECTRICAL CONNECTOR

BACKGROUND OF THE INVENTION

1. Field of the Invention

The present invention relates to an electrical connector, and particularly to an electrical connector mountable at a panel opening.

2. Description of Prior Art

A panel mounted electrical connector is known as an electrical connector mounted at an opening in a computer panel for mating with a complementary connector through the opening. The panel mounted connector can be either a receptacle connector or a plug connector. Such a connector is typically electrically connected to a printed circuit board fixed within a computer incorporating the panel.

U.S. Pat. No. 5,709,569 discloses a panel mounted connector 84 which is mounted to a conductive panel 82 by the help of a bracket 80 as shown in FIG. 5. The bracket 80 is adapted to be attached to the conductive panel 82 for mounting the connector 84 thereto. The connector 84 is terminated to a cable 86. The bracket 80 comprises upper and lower support sections 804 and 806 extending rearward from a panel mounting body 802 thereof. The connector 84 is received between the upper and lower support sections 804 and 806 with a shield 842 thereof being soldered to the support sections 804 and 806 thereby defining a connector-bracket subassembly. A pair of screwed holes 808 is defined in opposite ends of the panel mounting body 802 in alignment with holes 822 in the panel 82 for threadedly engaging with screws 88 extending through the holes 822 into the threaded holes 808 thereby securely attaching the connector-bracket subassembly to the panel 82. A plug receiving cutout 809 is defined in the bracket 80 in alignment with an opening 824 in the panel 82 for exposing the connector 84 to an outside environment so that it can engage with a complementary connector (not shown). One problem with such a design is that a separate bracket must be stamped and formed, which complicates manufacturing and increases production cost. In addition, assembly and disassembly of the connector-bracket subassembly to and from the panel 82 is also time-consuming since the connector is mounted to the panel by a thread fastening mechanism.

U.S. Pat. No. 5,037,325 also discloses a panel mounted electrical connector with a pair of latch arms provided on opposite sides of a housing thereof for engaging edges of an opening in a computer panel. Each latch arm is integrally molded on the housing and is connected to the housing by a hinge. A gasket is sandwiched between the panel and a flange of the connector for providing good sealing characteristics. One problem with such a design is that the configuration of the latch arm is complicated and a separate gasket must be required. Furthermore, disassembly of the connector from the panel is inconvenient.

Therefore, a panel mounted electrical connector is desired which has reduced components and which facilitates assembly and disassembly of the connector to and from a computer panel.

SUMMARY OF THE INVENTION

Accordingly, one object of the present invention is to provide a panel mounted electrical connector with reduced components for reducing manufacturing cost.

Another object of the present invention is to provide a panel mounted electrical connector for facilitating assembly and disassembly of the connector to and from a computer panel.

In order to achieve the objects set forth, a panel mounted electrical connector in accordance with the present invention comprises a dielectric housing with a plurality of terminals received therein, a shield enclosing the housing, a cable having conductors terminated to the terminals, and an insulative casing injection molded to engage with a rear end portion of the housing and a front end of the cable.

The casing is made from resilient material and comprises a push portion at a top, front end thereof. The shield includes a top wall and a pair of opposite side walls downwardly extending from the top wall. The side walls are interferentially received in side slots defined between the housing and the casing, and the top wall is spaced from an upper surface of the housing. Each side wall defines a cutout extending rearward from a front edge thereof. A first latch is formed by each side wall of the shield and downwardly extends into the cutout for engaging with a second latch formed by the panel and located on each side of an opening in a computer panel.

The connector is mounted to the panel by engaging the first latches of the shield thereof with corresponding second latches of the panel. A support plate is provided by the panel at a bottom edge of the opening for extending into a lower slot defined between the casing and the housing thereby retaining the connector in position relative to the panel. When disassembly of the connector from the panel is desired, the first latches of the shield are unlatched from the second latches of the panel by simply depressing the push portion of the casing against the top wall of the shield.

Other objects, advantages and novel features of the invention will become more apparent from the following detailed description when taken in conjunction with the accompanying drawings.

DETAILED DESCRIPTION OF THE INVENTION

Figure 1:
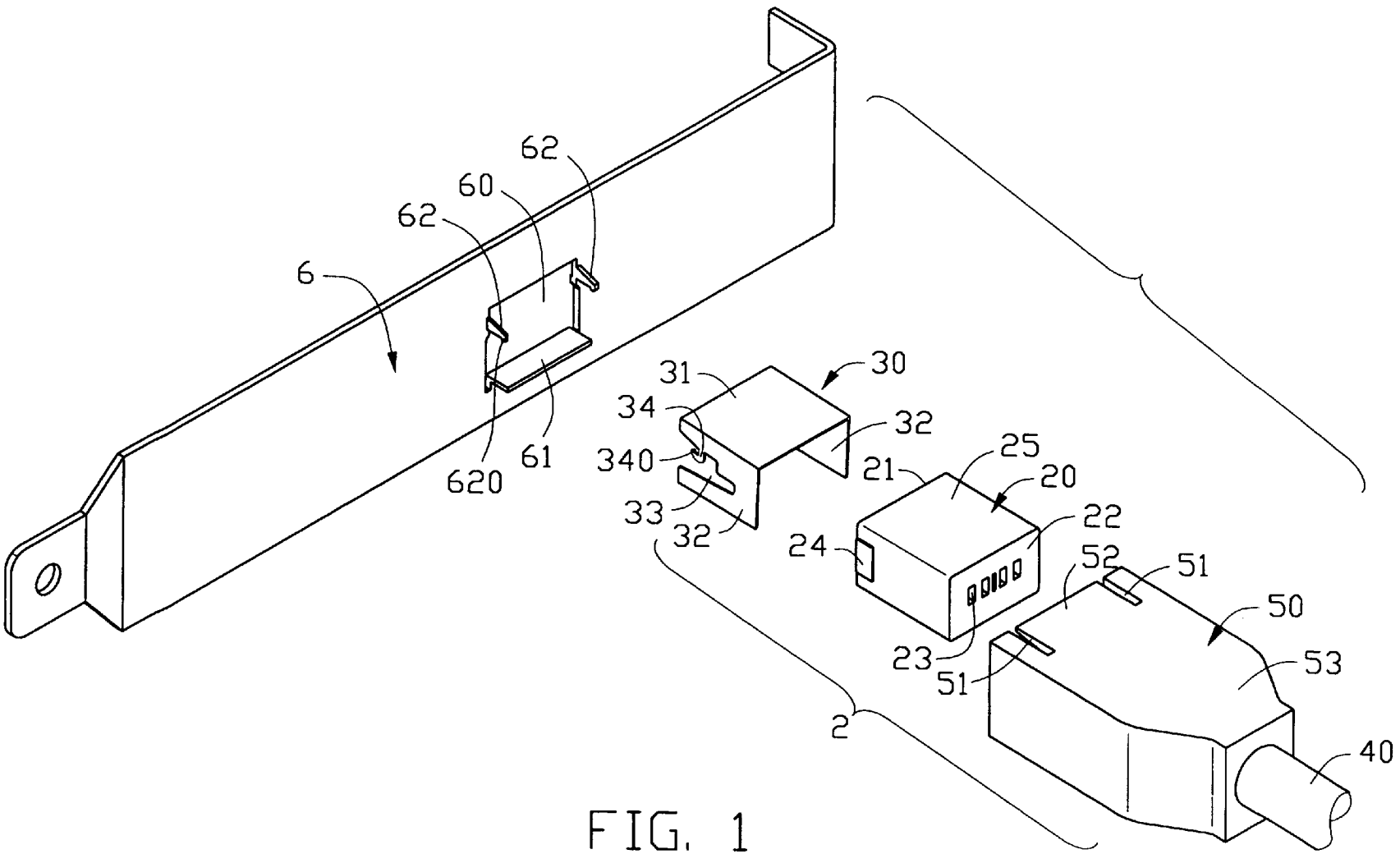
FIG. 1 is a rear exploded view showing a shield, a dielectric housing and an insulative casing of an electrical connector in accordance with the present invention adapted for being mounted to a panel.

Reference will now be made to the drawing figures to describe the present invention in detail.

FIG. 1 shows an exploded view of an electrical connector 2 of the present invention which is located within a computer enclosure (not shown). The connector 2 is used to be mounted to an opening 60 in a conductive computer panel 6. The connector 2 comprises a dielectric housing 20 with a plurality of terminals (not shown) received therein, a shield 30 enclosing the housing 20 for providing EMI shielding, a cable 40 having insulated electrical conductors (not shown) for being terminated to the terminals, and an insulative casing 50 for enclosing the housing 20 and a front end of the cable 40.

The dielectric housing 20 defines a plurality of passageways 23 from a front mating surface 21 to a rear connecting surface 22 thereof for receiving the terminals. A pair of protrusions 24 is provided on opposite sides of the housing 20 proximate the mating surface 21.

The shield 30 includes a top wall 31 and a pair of side walls 32 downwardly extending from the top wall 31 for cooperatively enclosing the housing 20. Each side wall 32 defines an elongate cutout 33 extending rearward from a front edge of the side wall 32. Each side wall 32 further forms a first latch 34 downwardly extends into the cutout 33. Each first latch 34 has a forwardly and upwardly projecting hook 340 for engaging with a downwardly projecting hook 620 of a corresponding second latch 62 projecting rearward from the panel 6 near one of two opposite side edges of the opening 60 in the panel 6.

The insulative casing 50 is made of a somewhat resilient material, such as PVC or the like, for providing resiliency thereof. A pair of grooves 51 is defined in a front end of an upper wall 53 of the casing 50 thereby defining a resilient push portion 52 therebetween, whose function will be detailed below. The push portion 52 has a lower surface 520 (FIG. 2) tapering toward a free end thereof.

Figure 2:
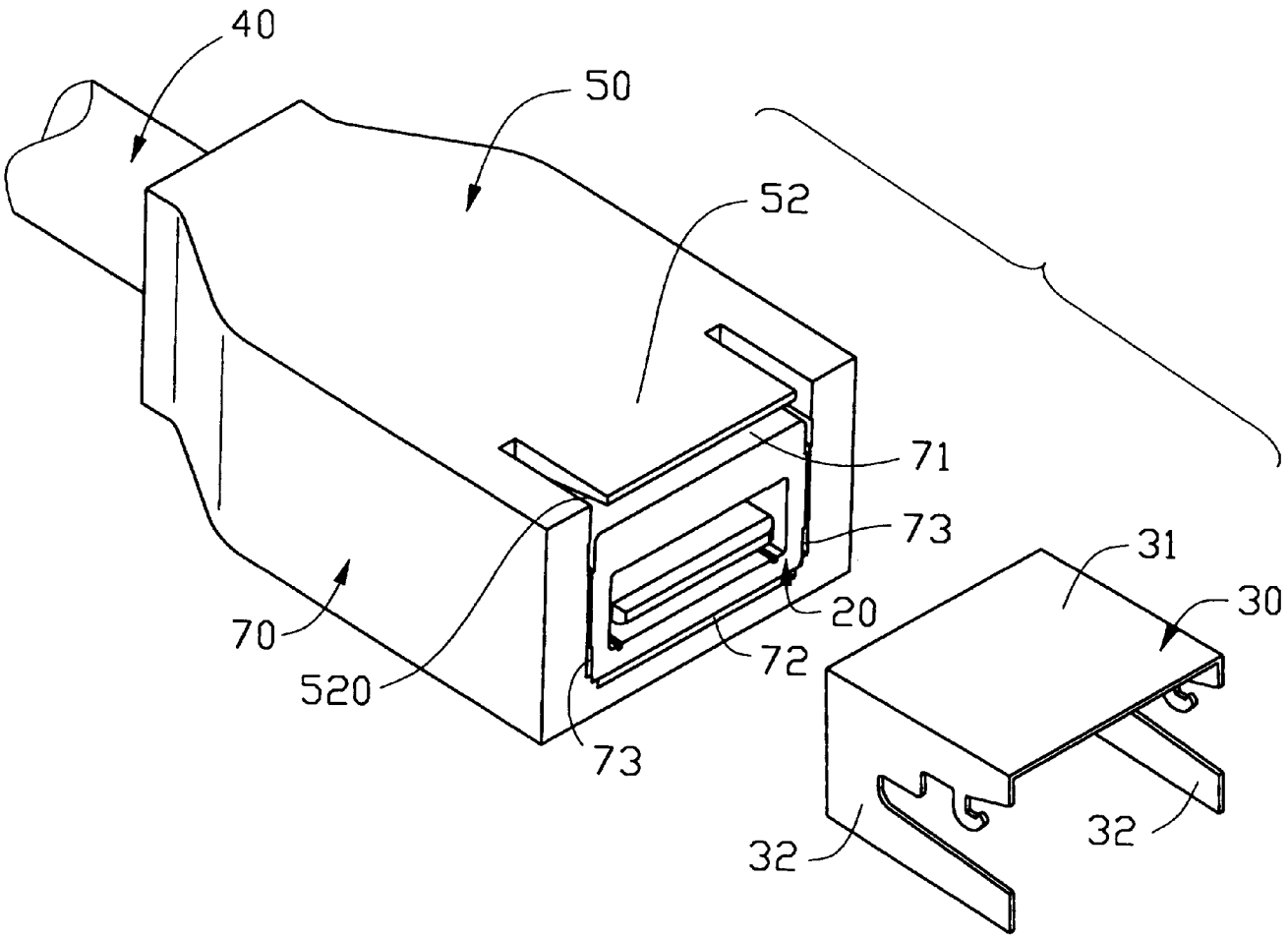
FIG. 2 is a front perspective view of the insulative casing with the dielectric housing retained therein, and the shield adapted to be inserted into receiving slots defined between the casing and the housing.
Figure 4:
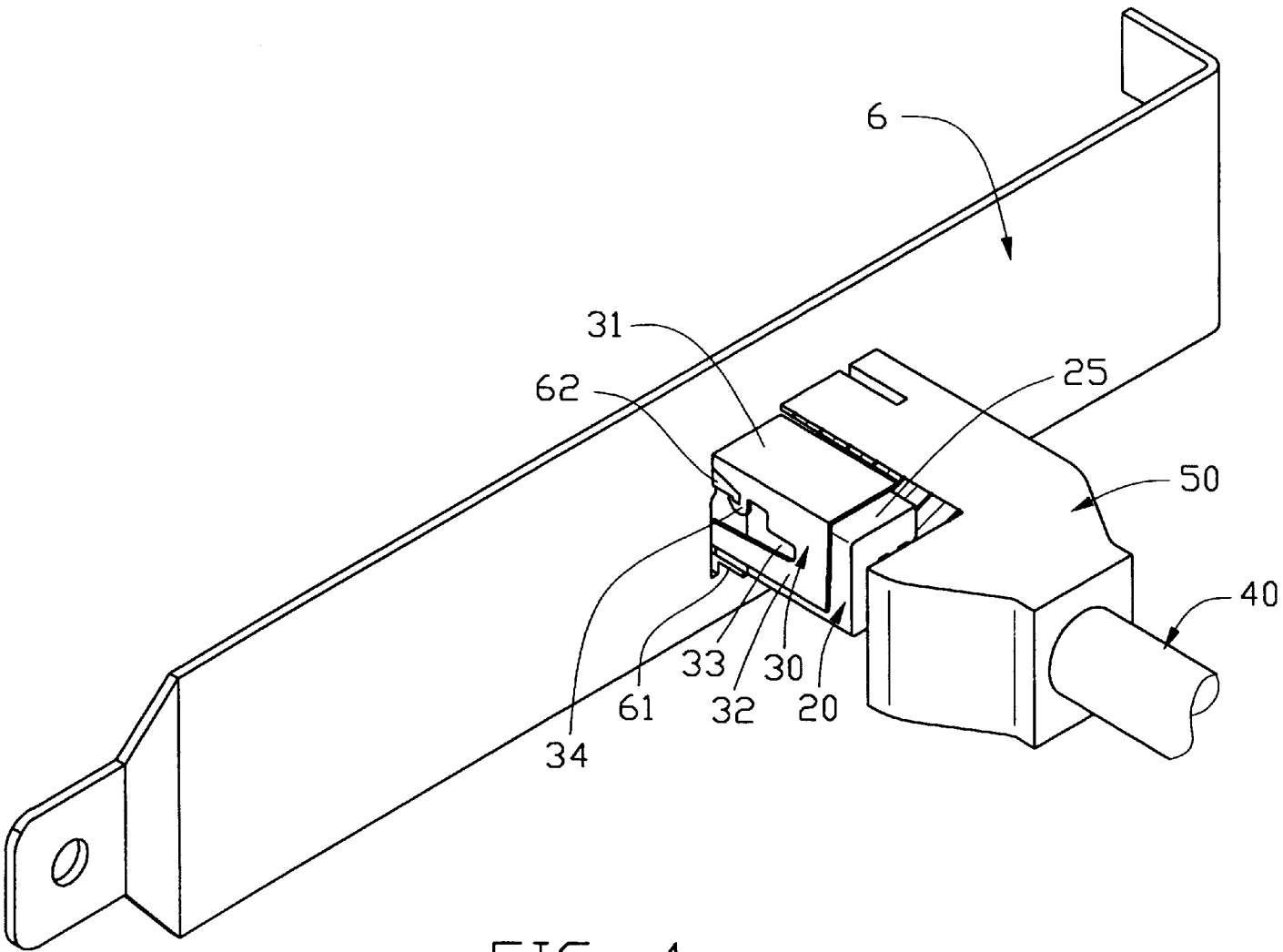
FIG. 4 is an enlarged view of FIG. 3, with a part of the insulative casing being cut away.
Figure 5:
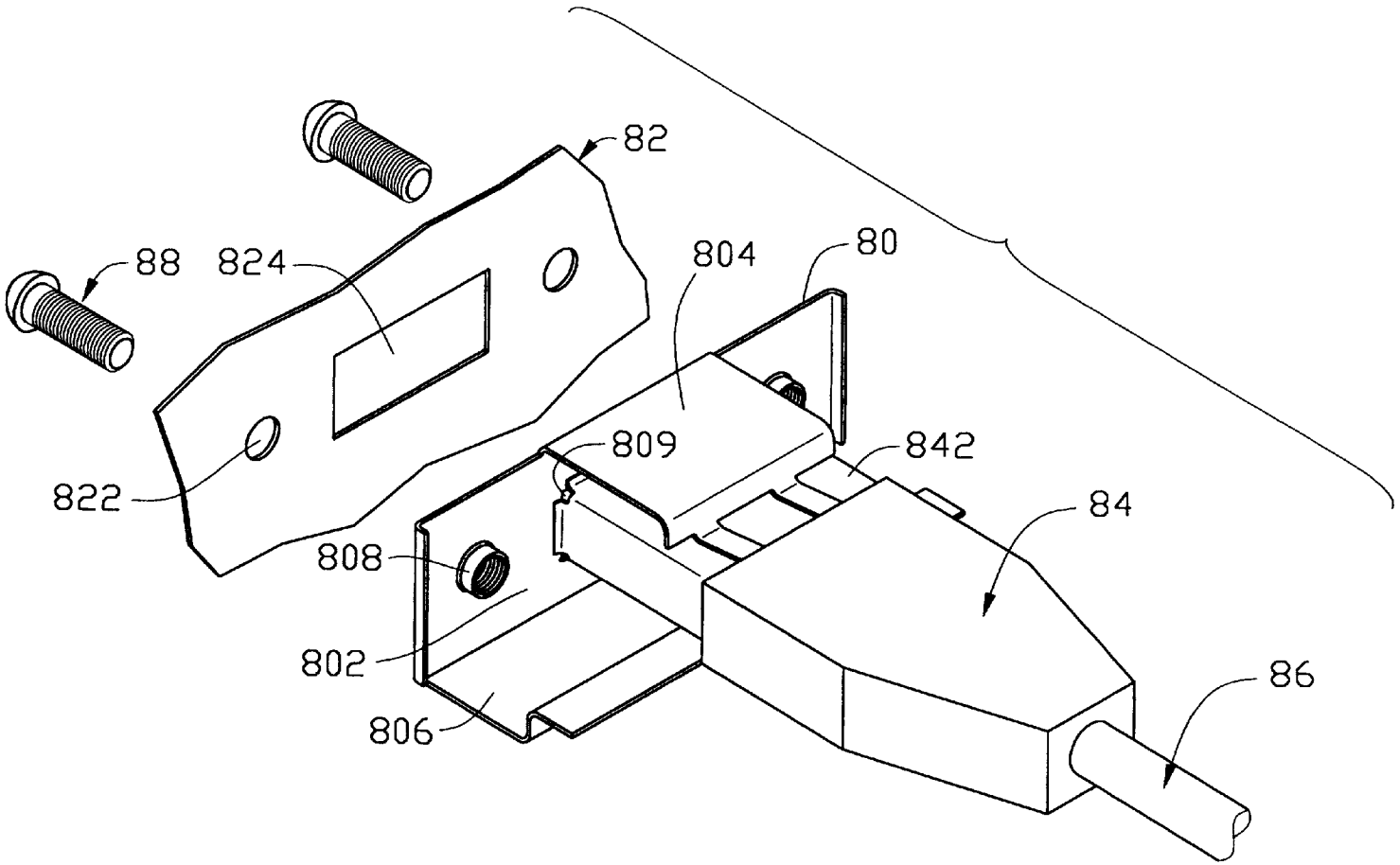
FIG. 5 (PRIOR ART)
FIG. 5 is a perspective view of a conventional electrical connector connected to a bracket for being mounted to a panel.

Also referring to FIGS. 2 and 4, in manufacturing of the electrical connector 2, the electrical conductors of the cable 40 are first terminated to the terminals received in the housing 20. As the termination of the conductors by the terminals is well known by persons skilled in the art and is not within the claimed scope of the present application, a detailed description thereof is omitted here. Melted plastic is then injection molded around the housing 20, the terminated terminals and conductors, and a front end of the cable 40 to form the insulative casing 50. Thus, the housing 20, the casing 50 and the cable 40 are formed as an integral subassembly 70 as shown in FIG. 2. In this molding process, only a rear end portion 25 of the housing 20, as best shown in FIG. 4, is in contact with the melted plastic. An upper slot 71, a lower slot 72 and a pair of opposite side slots 73 are defined between the casing 40 and the housing 20. Each side slot 73 has a width approximately equal to the thickness of the shield 30 for receiving the side walls 32 of the shield 30. The side walls 32 of the shield 30 are inserted into the side slots 73 along the protrusions 24 of the housing 20 to have an interferential fit with the subassembly 70. Thus, the shield 30 is fixedly received in the subassembly 70. The top wall 31 of the shield 30 is accommodated in the upper slot 71 and is spaced from an upper surface 25 of the housing 20 as illustrated in FIG. 4. Thus, a panel mounted electrical connector 2 in accordance with the present invention is obtained.

Figure 3:
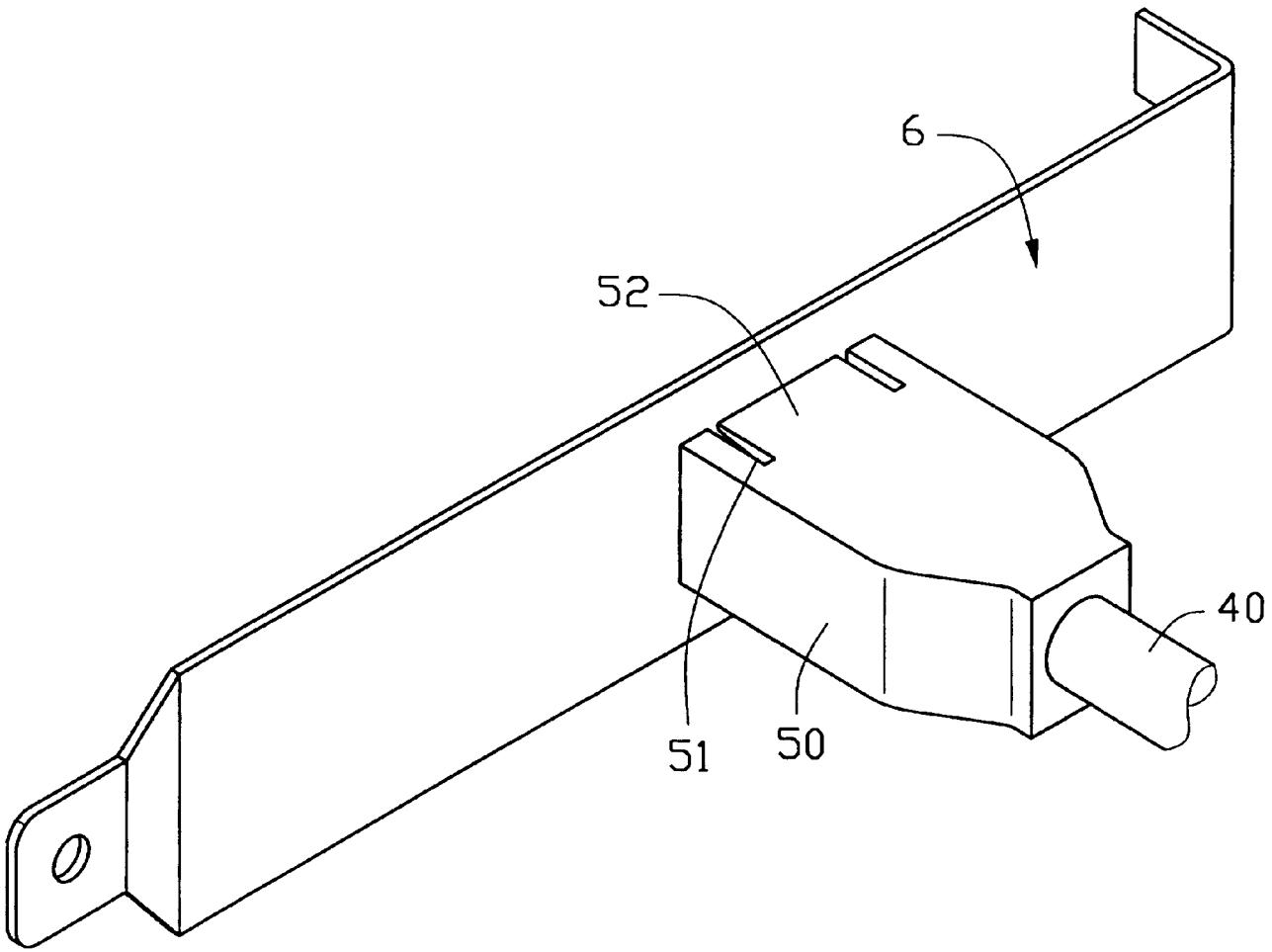
FIG. 3 is an assembled view of FIG. 1.

The connector 2 then moves toward the opening 60 in the panel 6 to lock the first latches 34 thereof to the corresponding second latches 62 on opposite sides of the opening 60. A support plate 61 is formed by the panel 6 to extend rearward from a bottom edge of the opening 60. The support plate 61 is used to be fittingly inserted into the lower slot 72 of the subassembly 70 thereby securely retaining the connector 2 in position relative to the panel 6, as shown in FIG. 3. When disassembly of the connector 2 from the panel 6 is desired, the engaged first and second latches 34 and 62 can be easily unlatched from each other by downwardly depressing the push portion 52 of the casing 50 against the top wall 31 of the shield 30, thereby causing the first latches 34 to move downward to leave their engagement with the second latches 62. As described above, due to the provision of the first and second latches 34 and 62, and the push portion 52 of the casing 50, assembly and disassembly of the connector 2 in accordance with the present invention to and from the panel 6 is significantly facilitated. Furthermore, the number of components of the connector 2 is reduced compared to the conventional designs since the first and second latches 34 and 62 are directly provided by the shield 30 and the panel 6, respectively.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

I claim:

1. An electrical connector mounted at an opening in a computer panel for mating with a complementary connector through the opening, comprising:

a dielectric housing defining a plurality of passageways therein;

a plurality of terminals received in the passageways;

a shield comprising a top wall and a pair of opposite side walls downwardly extending from the top wall for enclosing the housing, each side wall having a first latch for engaging with a second latch on each side edge of the opening in the computer panel;

a cable having electrical conductors terminated to the terminals; and an insulative casing enclosing the housing and the cable, the casing having an upper wall with a pair of opposite slots defined in a front edge thereof, a push portion being defined between the slots for being depressed against the top wall of the shield to unlatch the first latches of the shield from the second latches of the panel;

wherein each side wall of the shield defines a cutout, and the first latch extends into the cutout;

wherein each first latch of the shield has a forwardly and upwardly projecting hook, and the corresponding second latch of the computer panel has a downwardly projecting hook to engage with the forwardly and upwardly projecting hook of the corresponding first latch;

wherein the push portion of the casing has a lower surface tapering toward a free end thereof;

wherein the casing is molded to engage with a rear end portion of the housing to leave an upper slot, a lower slot and a pair of opposite side slots between the casing and a front end portion of the housing;

wherein the side walls of the shield are interferentially received in the side slots, and the top wall of the shield is received in the upper slot and spaced from an upper surface of the housing;

wherein the lower slot is adapted for receiving a support plate extending from a bottom edge of the opening in the panel;

wherein the housing comprises a pair of protrusions on opposite sides proximate a front end thereof for facilitating retention of the side walls of the shield in the side slots.

* * * * *